US005645968A

United States Patent [19]

Sacripante et al.

[11] Patent Number: 5,645,968

[45] Date of Patent: Jul. 8, 1997

[54] CATIONIC TONER PROCESSES

[75] Inventors: Guerino G. Sacripante; Maureen M. Kedian; Raj D. Patel, all of Oakville; Walter Mychajlowskij, Georgetown; Beng S. Ong, Mississauga, all of Canada

[73] Assignee: Xerox Corporation, Stamford, Conn.

[21] Appl. No.: 726,600

[22] Filed: Oct. 7, 1996

[51] Int. Cl.[6] ..... G03G 9/087

[52] U.S. Cl. ..... 430/137; 523/335; 523/339

[58] Field of Search ..... 430/137; 523/335, 523/339

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,346,797 | 9/1994 | Kmiecik-Lawrynowicz et al. | 430/137 |

*Primary Examiner*—Roland Martin
*Attorney, Agent, or Firm*—E. O. Palazzo

[57] ABSTRACT

A process for the preparation of toner comprising (i) preparing, or providing a cationic emulsion resin latex comprised of a resin derived from at least one olefinic nonpolar monomer, a cationic olefinic monomer, a cationic free radical initiator, and optionally a chain transfer agent in an aqueous mixture comprised of a nonionic surfactant and a cationic surfactant, and which mixture is heated at a temperature of from about 60° C. to about 95° C.;

(ii) adjusting the pH of said cationic latex to from about 10 to about 14 by the addition of a base;

(iii) preparing, or providing a pigment dispersion, which dispersion is comprised of a pigment and an anionic surfactant, and optionally a charge control agent;

(iv) shearing said pigment dispersion with the pH adjusted latex of (ii) and heating below about the resin Tg to form electrostatically bound toner size aggregates, and optionally adding a cationic surfactant to stabilize the size of the toner aggregates; and (v) heating said electrostatically bound toner size aggregates above about the Tg of the resin to form coalesced toner particles; followed by optionally filtering, washing and drying the toner obtained.

27 Claims, No Drawings

CATIONIC TONER PROCESSES

BACKGROUND OF THE INVENTION

The present invention is generally directed to toner processes, and more specifically, to aggregation and coalescence processes for the preparation of toner compositions In embodiments, the present invention is directed to the economical in situ chemical preparation of toners without the utilization of the known pulverization and/or classification methods, and wherein in embodiments toner compositions with an average volume diameter of from about 1 to about 25, and preferably from 1 to about 10 microns, and narrow GSD of, for example, from about 1.2 to about 1.4, and from about 1.16 to about 1.35 as measured on the Coulter Counter can be obtained. The resulting toners can be selected for known electrophotographic imaging and printing processes, including color processes, and lithography In embodiments, the present invention is directed to a process for the preparation of toner, or toner particles comprised of resin and pigment, and wherein a cationic resin emulsion is selected, and wherein cationic based initiators and surfactants are selected. The emulsion particles are preferably adjusted to a high pH of, for example, from about 10 to about 12 by adding a base component thereto, followed by aggregation with pigments and anionic surfactant adjusted to a particle size ranging from about 4 to about 11 microns with a geometric distribution of from about 1.2 to about 1.4 by the addition of cationic surfactant, and heated to enable coalescing of the resin and pigment, and which heating is accomplished at an effective temperature of, for example, from about 50 to about 95° C. Of importance with respect to the processes of the present invention is preparing, or providing a cationic emulsion resin latex comprised of at least one olefinic nonpolar monomer, a cationic olefinic monomer, a cationic free radical initiator, and optionally a chain transfer agent in an aqueous mixture comprised of a nonionic surfactant and a cationic surfactant. A number of advantages are associated with the processes of the present invention including enabling the generation of positively charging stable toners, such as from about 5 to about 30 microcoulombs per gram as measured by the Faraday Triboelectric Cage There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. Negatively charged rather than positively charged toners are believed to be obtained with these prior art processes in that, for example, anionically generated toner particles result.

Emulsion/aggregation processes, especially anionic processes for the preparation of toners, are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

In a number of prior art patents, the emulsion-aggregation process is primarily directed to anionic latexes and anionic initiators in acidic pH to enable the preparation of negative charging toners. With the present invention, positive charging toners are prepared by an emulsion aggregation process involving cationic latexes, and more importantly utilizing cationic initiators, and wherein the process is accomplished in basic pH range of greater than 7 and preferably from about 10 to about 12.

In the present invention, a process for the preparation of a positively charging toner is illustrated, and which process includes in embodiments a number of steps, of which one is comprised of generating a cationic resin latex derived from at least one olefinic monomer such as styrene, butyl acrylate, butadiene and the like, a cationic monomer such as vinylpyridine, acrylamide, 3-methacryloxy-2-hydroxypropyltrimethyl ammonium chloride salt and the like, a cationic free radical initiator such as 2,2'-azobis(N, N'-dimethylene isobutyramidine) dihydrochloride and the like, a nonionic surfactant and cationic surfactant. Another step involves adjusting the cationic latex to a pH of from about 8 to about 14, and preferably of from about 10 to about 12 utilizing a base such as an alkali hydroxide, or an alkali metal carbonate, such as sodium hydroxide or sodium carbonate, and followed by adding a pigment dispersion with an anionic surfactant thereby resulting in a composite aggregate comprised of cationic emulsion particles and pigment, wherein the composite particle has a particle size of from about 5 to about 9 microns (volume average diameter throughout) and a geometric size distribution of from about 1.2 to about 1.4. Subsequently, the composite resulting is heated to a temperature above the glass transition temperature of the latex to afford coalesced toner particles, followed by filtration, washing, and drying to yield positive charging toners.

It is believed that the triboelectric charge of a toner is influenced not only by the pigments and additives selected, but also by the composition of the resin. Generally, anionic groups on the resin such as carboxylic acid and its alkali derivatives, sulfonic acid groups or its alkali derivatives provide negative charging toners. Additionally, when initiators are used in preparing the resin, such as by emulsion process, for example, potassium persulfate or ammonium persulfate, this results in further addition of moieties on the resin and contribute to the charging of the resultant toner. Thus, anionic initiators, such as potassium persulfate or ammonium persulfate, contribute to the negative charging of toners. In contrast, cationic groups on a resin, such as nitrogen containing groups, for example pyridine moieties, tetralkyl ammonium salts or phosphines, result in positively charging toners. Similarly, when the resin is prepared by an emulsion process, cationic initiators are preferred such as the hydrochloride salts of azo bisamidines and the like.

SUMMARY OF THE INVENTION

Examples of objects of the present invention in embodiments thereof include:

It is an object of the present invention to provide toner processes with many of the advantages illustrated herein.

In another object of the present invention there are provided simple and economical processes for the direct preparation of black and colored positively charged toner compositions.

In another object of the present invention there are provided simple and economical processes for the direct preparation of black and stable colored toner compositions with, for example, excellent pigment dispersion and narrow GSD, and wherein rejection or pigment, especially yellow pigment, destabilization is avoided or minimized.

In another object of the present invention there are provided emulsion/aggregation/coalescence processes wherein pigment destabilization, especially of yellow pigments, is avoided or minimized.

In another object of the present invention there are provided simple and economical in situ processes for black and colored toner compositions wherein styrenic based latexes are selected with basic or cationic monomer for particle charge, such as vinyl pyridine, acrylamides, tetralkyl ammonium methacrylates, and the like.

In a further object of the present invention there is provided a process for the preparation of toner compositions with a volume average particle diameter of from between about 1 to about 20 microns, and preferably from about 1 to about 7 microns, and with a narrow GSD of from about 1.2 to about 1.3 and preferably from about 1.16 to about 1.31 as measured by a Coulter Counter.

In a further object of the present invention there is provided a process for the preparation of toner compositions with certain effective particle sizes by controlling the temperature of the aggregation which process comprises stirring and heating about below the resin glass transition temperature (Tg).

Moreover, in a further object of the present invention there is provided a process for the preparation of toner compositions which after fixing to paper substrates results in images with a gloss of from 20 GGU (Gardner Gloss Units) up to 80 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions with low fusing temperatures of from about 110° C. to about 150° C, and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of cationic latex particles with pigment particles dispersed in water and a surfactant, and wherein the aggregated particles of toner size can then be caused to coalesce by, for example, heating. In embodiments, some factors of importance with respect to controlling particle size and particle size distribution include the concentration of the surfactant used for the pigment dispersion, the concentration of the resin component like vinyl pyridine in the latex, the temperature of coalescence, and the time of coalescence.

These and other objects of the present invention are accomplished in embodiments by the provision of toners and processes thereof. In embodiments of the present invention, there are provided processes for the economical direct preparation of toner compositions by flocculation or heterocoagulation and coalescence, and wherein the temperature of aggregation can be utilized to control the final toner particle size, that is average volume diameter.

Embodiments of the present invention include a process for the preparation of toner comprising (i) preparing, or providing a cationic latex generated by the emulsion free radical process of at least one olefinic monomer, such as styrene, butylacrylate, butadiene and mixtures thereof, at least one cationic monomer such vinylpyridine, a cationic free radical initiator, such as 2,2'-azobis(N,N'-dimethylene isobutyramidine) dihydrochloride, a cationic surfactant such as benzyltrialkyl ammonium chloride, a nonionic surfactant such as polyethyleneoxide-phenylnonylether, and optionally a chain transfer agent, such as dodecanethiol and carbon tetrabromide, in water at a temperature of from about 60 to about 75° C. for a duration of from about 3 to about 9 hours;

(ii) adjusting the pH of the latex to about 10 to about 12 by the addition of a base such as an alkali metal carbonate like sodium carbonate or an alkali metal hydroxide like sodium hydroxide;

(iii) preparing, or providing a pigment dispersion, which dispersion is comprised of a pigment, an anionic surfactant such as sodium dodecylbenzene sulfonate, and optionally a charge control agent;

(iv) shearing the pigment dispersion with the pH adjusted latex resulting to form aggregates, especially electrostatically bound toner size aggregates, and optionally adding a cationic surfactant primarily to stabilize the size of the aggregates; heating below about or at the resin Tg; followed by (v) heating the aggregates above about or at the Tg of the resin to form coalesced toner particles; followed by filtering, washing and drying the toner product, and which toner is comprised of resin and pigment, and optional charge control additive or agent.

The present invention in embodiments relates to a process for the preparation of toner comprising (i) providing a cationic emulsion resin latex comprised of at least one olefinic nonpolar monomer, a cationic olefinic monomer, a cationic free radical initiator, and optionally a chain transfer agent in an aqueous mixture comprised of a nonionic surfactant and a cationic surfactant, and which mixture is heated at a temperature of from about 60 to about 95° C. for a duration of from about 3 to about 9 hours;

(ii) adjusting the pH of said cationic latex to from about 10 to about 14, and preferably to about 12 by the addition of a base;

(iii) providing a pigment dispersion, which dispersion is comprised of a pigment, and an anionic surfactant, and optionally a charge control agent;

(iv) shearing the pigment dispersion with the pH adjusted latex of (ii) to form electrostatically bound toner size aggregates, optionally and preferably adding a cationic surfactant to stabilize the size of the toner aggregates; heating below the resin Tg;

(v) heating the electrostatically bound toner size aggregates above about the Tg of the resin to form coalesced toner particles; followed by optionally filtering, washing and drying the toner obtained; and a process comprising shearing a pigment dispersion comprised of a pigment, and an anionic surfactant, and optionally a charge control agent with a latex dispersion at a pH of from about 10 to about 14 and preferably about 12, wherein the latex dispersion is comprised of a cationic emulsion latex comprised of at least one olefinic nonpolar monomer, at least one cationic olefinic monomer, a cationic free radical initiator, and optionally a chain transfer agent in an aqueous mixture comprised of a nonionic surfactant and cationic surfactant, and which mixture is heated; and heating above about the Tg of the resin to form coalesced toner particles.

The process sequence can be in the order as illustrated herein, such as (i) to (v), however, other sequences can be selected in embodiments, for example the pigment dispersion can be added to and/or mixed with the latex, the latex can be added to and/or mixed with the pigment dispersion, the latex and pigment dispersion can be prepared, the latex and the pigment dispersion can be provided, and the like.

In embodiments, the present invention is directed to processes for the preparation of toner compositions, which processes comprise initially attaining or generating a cationic emulsion latex comprised of a resin derived from the free-radical polymerization in water of an olefinic monomer, such as styrene, butyl acrylate, butadiene, mixtures thereof and the like, and at least one cationic monomer component, such as vinylpyridine, in an aqueous surfactant mixture containing a cationic surfactant, a nonionic surfactant and a cationic initiator, such as a water soluble azo component, and optionally at least one chain transfer, such as a thiol or halogenated carbon, to result in a latex; heating the mixture to generate an emulsion latex mixture comprised of polymeric particles in water wherein the particle diameter size of the suspended resin mixture is, for example, from about 0.01 to about 0.5 micron. The cationic latex is then treated with base, such as sodium hydroxide, to adjust the pH to about 12. Thereafter, a pigment dispersion is prepared, for example, by dispersing an aqueous mixture of a pigment or pigments, such as carbon black like REGAL 330®, phthalocyanine, quinacridone or RHODAMINE B™ type with an anionic surfactant, such as sodium dodecylbenzene sulfonate, by utilizing a high shearing device, such as a Brinkmann Polytron, and thereafter, shearing this mixture with the prepared cationic latex by utilizing a high shearing device, such as a Brinkmann Polytron, a sonicator or microfluidizer, and thereafter, heating below the resin Tg resulting in a flocculation, or heterocoagulation of the polymer or resin with the pigment particles caused primarily by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5 to about 15° C., and allowing the formation of electrostatically stabilized aggregates ranging in size of from about 0.5 micron to about 10 microns in volume average diameter; followed by heating above about the resin Tg, for example from about 5 to about 50° C., to cause coalescence of the latex, and pigment particles, followed by washing with, for example, hot water at about 40 to about 70° C. to remove, for example, surfactants, and drying, such as by use of an Aeromatic fluid bed dryer, freeze dryer, or spray dryer, whereby toner particles comprised of resin, pigment, and optional charge control additive with various particle size diameters can be obtained, such as from about 1 to about 10 microns in volume average particle diameter as measured by the Coulter Counter.

Illustrative examples of specific resin particles, resins or polymers selected for the latex in the process of the present invention, and resulting from the nonpolar olefinic monomer, and the cationic olefinic monomer include polymers, such as terpoly-(styrene-butadiene-vinylpyridine), terpoly-(styrene-butylacrylate-vinylpyridine), terpoly-(butylacrylate-butadiene-vinylpyridine), terpoly-(styrene-butylmethacrylate-vinylpyridine), terpoly-(styrene-ethylacrylate-vinylpyridine), terpoly-(propylacrylate-butadiene-vinylpyridine), terpoly-(styrene-2-ethylhexylmethacrylate-vinylpyridine), terpoly-(styrene-butadiene-acrylamide), terpoly-(styrene-butylacrylate-acrylamide), terpoly-(butylacrylate-butadiene-acrylamide), terpoly-(styrene-butylmethacrylate-acrylamide), terpoly-(styrene-ethylacrylate-acrylamide), terpoly-(propylacrylate-butadiene-acrylamide), terpoly-(styrene-butadiene-methacrylamide), terpoly-(styrene-butylacrylate methacrylamide), terpoly-(butylacrylate-butadiene-methacrylamide), terpoly-(styrene-butylmethacrylate-methacrylamide), terpoly-(styrene-ethylacrylate-acrylamide), terpoly-(propylacrylate-butadiene-acrylamide), terpoly-(styrene-2-ethylhexylmethacrylate-acrytamide), mixtures thereof, and the like. The resin selected can be present in various effective amounts, such as from about 85 weight percent to about 98 weight percent of the toner.

The olefinic monomer selected for the process of the present invention includes in embodiments, for example, styrene, methylstyrene, butadiene, isoprene, methyl acrylate, ethyl acrylate, propyl acrylate, butyl acrylate, pentyl acrylate, hexyl acrylate, 2-ethyl acrylate, octyl acrylate, decyl acrylate, lauryl acrylate, stearyl acrylate, methyl methacrylate, ethyl methacrylate, propyl methacrylate, butyl methacrylate, pentyl methacrylate, hexyl methacrylate, 2-ethyl methacrylate, octyl methacrylate, decyl methacrylate, lauryl methacrylate, stearyl methacrylate, mixtures thereof and the like, and this monomer is selected in various effective amounts, such as for example from about 80 to about 95 percent of the cationic emulsion resin.

The cationic monomer selected for the process of the present invention includes basic olefinic monomers, such as 2-vinylpyridine, 3-vinylpyridine, 4-vinylpyridine, acrylamide, methacrylamide, vinylpyrrolidone, vinyl-N-methylpyridinium chloride, 3-methacryloxy-2-hydroxypropyltrimethyl ammonium chloride salt, acryloxy-2-ethyl-tetralkyl ammonium chloride, acryloxy-3-propyl-tetralkyl ammonium chloride, methacryloxy-2-ethyl-tetralkyl ammonium chloride, methacryloxy-3-propyltetralkyl ammonium chloride, mixtures thereof and the like, and wherein the alkyl group contains, for example, from 1 to about 25 carbon atoms, such as methyl, ethyl, propyl, butyl, pentyl, hexyl, octyl, and the like, and wherein the cationic monomer is selected in various effective amounts, such as from about 1 to about 20, and from about 5 to about 10 percent of the emulsion resin.

Examples of cationic initiators selected for the process of the present invention include azo derivitized water soluble initiators, such as 2,2'-azobis(N,N'-dimethylene isobutyramidine) dihydrochloride, 2,2'-azobis(2-amidinepropane) dihydrochloride, 2,2'-azobis2methyl-N-[1,1-bis(hydroxymethyl)-2-hydroxyethyl]propion-amide, 2,2'-azobis2-metyl-N-[1,1-bis-(hydroxymethyl)-ethyl]propion-amide, 2,2'-azobis(isobutyramide) dihydrate, mixtures thereof and the like, and which initiator is selected in various effective amounts, such as from about 0.5 to about 5 percent of the emulsion resin. These and similar initiators are available from Wako Chemical Inc. as VA-080, VA-082, VA-086 and VA-088.

Examples of chain transfer agents selected for the process of the present invention include methanethiol, ethanethiol, propanethiol, butanethiol, pentanethiol, hexanethiol, decanethiol, dodecanethiol, carbon tetrabromide, carbon tetrachloride, bromoform, chloroform mixtures thereof and the like, and which agents are selected in various effective amounts, for example from about 0.01 to about 1 percent of the emulsion resin.

Surfactants in amounts of, for example, 0.1 to about 25 weight selected in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of monomer, or monomers selected to prepare the copolymer resin of the emulsion or latex blend.

Examples of ionic surfactants include sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers or monomer used to prepare the copolymer resin particles of the emulsion or latex blend.

Examples of anionic surfactants that can be selected in various effective amounts, such as from about 1 to about 10 weight percent, include sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

In embodiments, known cationic surfactants can be selected for the emulsion resin blend, such as an alkylbenzalkanium halide, especially the chloride, reference U.S. Pat. No. 5,370,964, especially column 22, lines 21 to 40, the disclosure of this patent being totally incorporated herein by reference. An effective amount of cationic surfactant is selected, for example the mount can be from about 0. 01 to about 10, and more specifically, from about 0.1 to about 5 weight percent of the components present in the emulsion resin latex.

Various known colorants or pigments present in the toner in an effective amount of, for example, from about 1 to about 25 percent by weight of the toner, and preferably in an amount of from about 1 to about 10 weight percent that can be selected include carbon black like REGAL 330™; magnetites, such as Mobay magnetites MO8029™, MO8060™; Columbian magnetites; MAPICO BLACK™ and surface treated magnetites; and the like. As colored pigments, there can be selected cyan, magenta, yellow, red, green, brown, blue or mixtures thereof. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™ and cyan components, may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of each of these patents being totally incorporated herein by reference, negative charge enhancing additives like aluminum complexes, and the like.

Surface additives that can be added to the toner compositions after washing or drying are known and include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carriers or carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

At least one in embodiments refers, for example, to 1 to about 10, and more specifically, from 1 to about 5, preferably from 1 to about 3, and at least one includes one. Examples of components, such as surfactants, selected for the processes of the present invention are illustrated in a number of patents mentioned herein, such as U.S. Pat. No. 5,346,797.

The following Examples are being submitted to further define various species of the present invention. These Examples are intended to be illustrative only and are not intended to limit the scope of the present invention. Also, parts and percentages are by weight unless otherwise indicated. Comparative Examples and data are also provided.

COMPARATIVE EXAMPLE I

Preparation of a latex comprised of 30 percent resin particles in water containing 1.7 percent nonionic surfactant (ANTAROX™) and 1.8 percent of cationic surfactant (SANIZOL B™), and wherein the resin is derived from styrene, butyl acrylate, and 3-methacryloxy-2-hydroxypropyltrimethyl ammonium chloride, dodecanethiol, carbon tetrabromide and an anionic initiator (ammonium persulfate).

A 1 liter Buchi reactor equipped with a mechanical stirrer was charged with styrene (328 grams), butyl acrylate (72 grams), dodecanethiol (12 grams), carbon tetrabromide (4 grams), 3-methacryloxy-2-hydroxypropyltrimethyl ammonium chloride (16 grams), water (500 grams), ANTAROX™ (8.6 grams), SANIZOL b™ (9 grams) and ammonium persulfate (4 grams). The mixture resulting was heated to 70° C. under nitrogen atmosphere for a duration of 6 hours. A 10 gram sample of this resin mixture was then freeze dried and evaluated with the following results: a resin number average molecular weight of 10,088 and a resin weight average molecular weight of 75,291, as measured by gel permeation chromatography using polystyrene as the standard. The glass transition of the resin was found to be 56° C. using the DuPont differential scanning calorimeter.

COMPARATIVE EXAMPLE II

Attempt to prepare a cyan toner comprised of 5 percent by weight of PV FAST BLUE™, and 95 percent by weight of terpoly(styrene-butylacrylate-3-methacryloxy-2-hydroxypropyltrimethy ammonium chloride) of Comparative Example I follows.

In a 1 liter flask equipped with a mechanical stirrer were added 300 grams of the latex of Comparative Example I. To this stirred mixture, was then added dropwise a 1 percent aqueous solution of potassium hydroxide until the pH was about 10, as measured using Litmus pH paper. The mixture was left stirring at 25° C. for a duration of three hours. In a separate 300 milliliter metal beaker was prepared a pigment dispersion by adding 15 grams of PV FAST BLUE™, 1.2 grams of NEOGEN R™ (anionic surfactant) and 100 grams of water, and which mixture was dispersed using a polytron at 8,000 revolutions per minute for a duration of 5 minutes. The pigment dispersion was then added to the 1 liter flask containing the latex followed by the addition of 100 grams of water. Particle aggregation did not occur. The mixture was then heated to about 60° C. during a 1 hour interval, and no aggregation was observed.

The above latex comprised of a cationic resin derived with an anionic initiator, such as ammonium persulfate, did not result in the aggregation or flocculation of resin particles and pigment. Adjusting the pH of the mixture to a pH of 2, 4, 7 or 12 also resulted in no particle aggregation.

EXAMPLE III

Preparation of a latex comprised of 30 percent resin particles in water containing 1.7 percent nonionic surfactant (ANTAROX™) and 1.8 percent of cationic surfactant (SANIZOL B™), dodecanethio, carbon tetrabromide and a cationic initiator (2,2'-azobis(N,N'-dimethyiene isobutyramidine) dihydrochloride), and wherein the resin is derived from styrene and butyl acrylate, and 3-methacryloxy-2-hydroxypropyltrimethyl ammonium chloride.

A 1 liter Buchi reactor equipped with a mechanical stirrer was charged with styrene (328 grams), butyl acrylate (72 grams), dodecanethiol (12 grams), carbon tetrabromide (4 grams), 3-methacryloxy-2-hydroxypropyltrimethyl ammonium chloride (16 grams), water (500 grams), ANTAROX™ (8.6 grams), SANIZOL B™ (9 grams) and 2,2'-azobis(N, N'-dimethylene isobutyramidine) dihydrochloride (13.5 grams). The resulting mixture was heated to 70° C. under a nitrogen atmosphere for a duration of 6 hours. A 10 gram sample was then freeze dried and evaluated with the following results: a number average molecular weight of 9,390 and a weight average molecular weight of 70,291 for the resin, as measured by gel permeation chromatography using polystyrene as standard. The glass transition of the resin was found to be 60° C. using the DuPont differential scanning calorimeter.

EXAMPLE IV

A 7.2 micron cyan toner comprised of 5 percent by weight of PV FAST BLUE™, and 95 percent by weight of terpoly (styrene-butylacrylate-3-methacryloxy-2-hydroxypropyltrimethyl ammonium chloride of Example III was prepared as follows:

In a 1 liter flask equipped with a mechanical stirrer were added 300 grams of the latex of Example III. To this stirred mixture was then added dropwise a 1 percent aqueous solution of potassium hydroxide until the pH was about 10, as measured using Litmus pH paper. The mixture was left stirring at 25° C. for a duration of three hours. In a separate 300 milliliter metal beaker was prepared a pigment dispersion by adding 15 grams of PV FAST BLUE™, 1.2 grams of NEOGEN R™ (anionic surfactant) and 100 grams of water, and which pigment was dispersed using a polytron at 8,000 revolution per minute for a duration of 5 minutes. The pigment dispersion was then added to the 1 liter flask containing the latex followed by the addition of 100 grams of water. Particle aggregation occurred and the flask mixture was homogenized at 2,000 revolutions per minute for a duration of 2 minutes at 25° C. The mixture was then heated to about 60° C. over a 1 hour period, followed by the addition of 0.5 gram of SANIZOL B™ in 25 grams of water. The mixture was then heated to 96° C. over a 2 hour period, followed by maintaining heating for an additional 3 hours, after which the mixture was cooled to room temperature, about 25° C., filtered off, washed excessively with water (about 16 liters), and dried by freeze drying. The toner particle size was then measured to be 7.2 microns with a geometric distribution of 1.32, as measured by the Coulter Counter. It is believed in the context of the present invention that the latex particle resin is to be derived with a cationic initiator and the other components of (i) to enable effective aggregation, coalescence, and the preparation of toners.

EXAMPLE V

Preparation of a latex comprised of 30 percent resin particles in water containing 1.7 percent nonionic surfactant (ANTAROX™) and 1.8 percent of cationic surfactant (SANIZOL B™), dodecanethiol, carbon tetrabromide and the cationic initiator (2,2'-azobis(N,N'-dimethylene isobutyramidine) dihydrochloride), and wherein the resin is derived from styrene, butyl acrylate, vinylpyridine, was prepared as follows:

A 1 liter Buchi reactor equipped with a mechanical stirrer was charged with styrene (264 grams), butadiene (36 grams), dodecanethiol (1.12 grams), carbon tetrabromide (3.75 grams), vinylpyridine (15 grams), water (500 grams), ANTAROX™ (10 grams), SANIZOL B™ (9 grams) and 2,2'-azobis(N,N'-dimethylene isobutyramidine) dihydrochloride (6.0 grams). The mixture was heated to 70° C. under nitrogen atmosphere for a duration of 6 hours. A 10 gram sample of the resin resulting was then freeze dried and was evaluated with the following results: a number average molecular weight of 6,697 and a weight average molecular weight of 24,498, as measured by gel permeation chromatography using polystyrene as standard. The glass transition of the resin was found to be 56° C. using the DuPont differential scanning calorimeter.

EXAMPLES VI to IX

Using the procedure of Example IV, a series of toners comprised of 95 percent by weight of resin and 5 percent by weight of pigment were prepared and are listed in Table 1.

TABLE 1

| Example | Pigment | Particle Size | GSD |
|---|---|---|---|
| Example VI | PV FAST BLUE | 5.4 microns | 1.35 |
| Example VII | FANAL PINK | 6.5 microns | 1.32 |
| Example VIII | REGAL 330 | 8.4 microns | 1.28 |
| Example IX | Pigment Yellow 14 | 9.1 microns | 1.30 |

The triboelectric properties of the above prepared toners and the toner of Example IV were evaluated by roll milling 3 percent by weight of the toner with 97 percent by weight of carrier, about 90 microns in diameter, comprised of a steel core with a polymer mixture thereover of 60 percent of polyvinylidene fluoride (KYNAR®) and 40 percent of polymethylmethacrylate. The triboelectric charge was then evaluated with a Faraday Cage at 2 relative humidity zones (both 20 and 80 percent RH). The results are shown in Table 2 that follows.

TABLE 2

| | Triboelectric Charge | |
|---|---|---|
| Toner | 20 RH | 80 RH |
| Example IV | 50 | 30 |
| Example VI | 25 | 15 |
| Example VII | 45 | 20 |
| Example VIII | 60 | 28 |
| Example IX | 12 | 6 |

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising (i) preparing, or providing a cationic emulsion resin latex comprised of a resin derived from at least one olefinic nonpolar monomer, a cationic olefinic monomer, a cationic free radical initiator, and optionally a chain transfer agent in an aqueous mixture comprised of a nonionic surfactant and a cationic surfactant, and which mixture is heated at a temperature of from about 60° C. to about 95° C.;

(ii) adjusting the pH of said cationic latex to from about 10 to about 14 by the addition of a base;

(iii) preparing, or providing a pigment dispersion, which dispersion is comprised of a pigment and an anionic surfactant, and optionally a charge control agent;

(iv) shearing said pigment dispersion with the pH adjusted latex of (ii) and heating below about the resin Tg to form electrostatically bound toner size aggregates, and optionally adding a cationic surfactant to stabilize the size of the toner aggregates; and (v) heating said electrostatically bound toner size aggregates above about the Tg of the resin to form coalesced toner particles; followed by optionally filtering, washing and drying the toner obtained.

2. A process in accordance with claim 1 wherein said base of (ii) is an alkali metal hydroxide, and (i) and (ii) are provided.

3. A process in accordance with claim 1 wherein said base is sodium hydroxide, potassium hydroxide, magnesium hydroxide, barium hydroxide, cesium hydroxide, lithium hydroxide, calcium hydroxide, ammonium hydroxide, or aluminum hydroxide.

4. A process in accordance with claim 1 wherein the nonpolar olefinic monomer is styrene, methylstyrene, butadiene, isoprene, methyl acrylate, ethyl acrylate, propyl acrylate, butyl acrylate, pentyl acrylate, hexyl acrylate, 2-ethyl acrylate, octyl acrylate, decyl acrylate, lauryl acrylate, stearyl acrylate, methyl methacrylate, ethyl methacrylate, propyl methacrylate, butyl methacrylate, pentyl methacrylate, hexyl methacrylate, 2-ethyl methacrylate, octyl methacrylate, decyl methacrylate, lauryl methacrylate, stearyl methacrylate, or mixtures thereof.

5. A process in accordance with claim 4 wherein the cationic olefinic monomer is 2-vinylpyridine, 3-vinylpyridine, 4-vinylpyridine, acrylamide, methacrylamide, vinylpyrrolidone, vinyl-N-methylpyridinium chloride, 3-methacryloxy-2-hydroxypropyltrimethyl ammonium chloride salt, acryloxy-2-ethyl-tetralkyl ammonium chloride, acryloxy-3-propyltetralkyl ammonium chloride, methacryloxy-2-ethyltetralkyl ammonium chloride, methacryloxy-3-propyltetralkyl ammonium chloride, and mixture thereof, and wherein alkyl is methyl, ethyl, propyl, butyl, pentyl, hexyl, or octyl.

6. A process in accordance with claim 1 wherein the emulsion resin in (i) is a styrenic based latex.

7. A process in accordance with claim 1 wherein the generated resin of the latex is terpoly-(styrene-butadiene-vinylpyridine), terpoly-(styrene-butylacrylate-vinylpyridine), terpoly-(butylacrylate-butadiene-vinylpyridine), terpoly-(styrene-butylmethacrylate-vinylpyridine), terpoly-(styrene-ethylacrylate-vinylpyridine), terpoly-(propylacrylate-butadiene-vinylpyridine), terpoly-(styrene-2-ethylhexylmethacrylate-vinylpyridine), terpoly-(styrene-butadiene-acrylamide), terpoly-(styrene-butylacrylate-acrylamide), terpoly-(butylacrylate-butadiene-acrylamide), terpoly-(styrene-butylmethacrylate-acrylamide), terpoly-(styrene-ethylacrylate-acrylamide), terpoly-(propylacrylate-butadiene-acrylamide), terpoly-(styrene-butadiene-methacrylamide), terpoly-(styrene-butylacrylate-methacrylamide), terpoly-(butylacrylate-butadiene-methacrylamide), terpoly-(styrene-butylmethacrylate-methacrylamide), terpoly-(styrene-ethylacrylate-acrylamide), terpoly-(propylacrylate-butadiene-acrylamide), terpoly-(styrene-2-ethylhexylmethacrylate-acrylamide), or mixtures thereof.

8. A process in accordance with claim 1 wherein the cationic initiator is an azo derivitized water soluble initiator.

9. A process in accordance with claim 1 wherein there is selected a cationic water soluble initiator selected from the group consisting of 2,2'-azobis(N,N'-dimethylene isobutyramidine) dihydrochloride, 2,2'-azobis(2-amidinopropane) dihydrochloride, 2,2'-azobis(N,N'-dimethylene isobutyramidine), 2,2'-azobis-2-methyl)-N-[1,1-bis(hydroxymethyl]propionamide, 2,2'-azobis-2-methyl-N[1,1-bis(hydroxymethyl)ethyl]propionamide, and 2,2'-azobis(isobutyramide)dihydrate.

10. A process in accordance with claim 1 wherein the nonpolar olefinic monomer is present in an amount of from about 85 to about 98 percent by weight of the resin present in the latex, the cationic olefinic monomer is present in an amount of from about 2 to about 15 percent by weight of the resin present in the latex, the optional chain transfer agent is present in an amount of from about 0.5 to about 3 percent by weight of the resin present in the latex, and the cationic initiator is present in an amount of from about 0.5 to about 5 percent by weight of the resin present in the latex.

11. A process in accordance with claim 1 wherein the toner is comprised of resin and pigment, wherein subsequent to cooling the toner is washed to remove surfactants, and wherein the particle size of the toner obtained is from about 3 to about 11 microns, and the geometric distribution thereof is from about 1.2 to about 1.4.

12. A process in accordance with claim 1 wherein the latex resin has a glass transition temperature of from about 50° C. to about 65° C.

13. A process in accordance with claim 1 wherein the latex resin generated has a number average molecular weight of from about 3,000 to about 50,000, a weight average molecular weight of from about 10,000 to about 150,000, and a polydispersity of from about 1.5 to about 10.

14. A process in accordance with claim 1 wherein the dispersion of (iii) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

15. A process in accordance with claim 1 wherein the heating of the blend of latex, pigment, surfactants and optional charge control agent in (iv) is accomplished at temperatures of from about 20° C. to about 5° C. below the Tg of the resin for a duration of from about 0.5 hour to about 6 hours.

16. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and wherein the anionic surfactant is selected from the group consisting of sodium dodecyl sulfate, sodium dodecylbenzene sulfate and sodium dodecylnaphthalene sulfate.

17. A process in accordance with claim 1 wherein the pigment is carbon black, magnetite, cyan, yellow, magenta, and mixtures thereof.

18. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and charge control agent.

19. A process in accordance with claim 1 wherein there is added to the surface of the formed toner metal salts, metal salts of fatty acids, silicas, metal oxides, or mixtures thereof in an amount of from about 0.1 to about 10 weight percent of the obtained toner particles.

20. A process in accordance with claim 1 wherein the resin Tg in (iv) is from about 50° C. to about 100° C., and wherein heating in (v) is from about 5° C. to about 50° C. above the Tg.

21. A process in accordance with claim 1 wherein the cationic surfactant is an alkylbenzalkonium chloride selected in an amount of from about 0.01 to about 10 weight percent.

22. A process for the preparation of toner comprising (i) providing a cationic emulsion resin latex comprised of a resin derived at least one olefinic nonpolar monomer, at least one cationic olefinic monomer, a cationic free radical initiator, and a chain transfer agent in an aqueous mixture comprised of a nonionic surfactant and a cationic surfactant;

(ii) adjusting the pH of said cationic latex to from about 10 to about 12 by the addition of a base;

(iii) providing a pigment dispersion, which dispersion is comprised of a pigment, and an anionic surfactant, and optionally a charge control agent;

(iv) shearing said pigment dispersion with the pH adjusted latex and heating below about the resin Tg resulting in aggregates, and adding a cationic surfactant to stabilize the size of the toner aggregates; followed by (v) heating said aggregates above about the Tg of the resin to form coalesced toner.

23. A process in accordance with claim 1 wherein from about 1 to about 3 different olefinic nonpolar monomers are selected.

24. A process in accordance with claim 4 wherein the cationic olefinic monomer is vinylpyridine.

25. A process in accordance with claim 1 wherein the generated resin of the latex is terpoly-(styrene-butadiene-vinylpyridine), or terpoly-(styrene-butylacrylate-vinylpyridine).

26. A process comprising shearing a pigment dispersion comprised of a pigment, and an anionic surfactant, and optionally a charge control agent with a latex dispersion at a pH of from about 10 to about 14, wherein said latex dispersion is comprised of a cationic emulsion resin latex comprised of a resin derived from at least one olefinic nonpolar monomer, at least one cationic olefinic monomer, a cationic free radical initiator, and optionally a chain transfer agent in an aqueous mixture comprised of a nonionic surfactant and cationic surfactant, and which mixture is heated below the resin Tg; and thereafter heating above about the Tg of the resin to form coalesced toner particles, followed by optionally isolating, drying and washing the toner obtained.

27. A process in accordance with claim 26 wherein said resin is obtained by the heating of said latex dispersion, and wherein there is accomplished isolating, washing and drying the toner obtained.

* * * * *